United States Patent [19]

Abouzahra et al.

[11] Patent Number: 4,947,143

[45] Date of Patent: Aug. 7, 1990

[54] MULTIPORT POWER DIVIDER-COMBINER

[75] Inventors: Mohamed D. Abouzahra, Burlington, Mass.; Kuldip C. Gupta, Boulder, Colo.

[73] Assignee: Massachusetts Institute of Technology, Cambridge, Mass.

[21] Appl. No.: 356,307

[22] Filed: May 23, 1989

[51] Int. Cl.[5] ..... H01P 5/12

[52] U.S. Cl. ..... 333/125; 333/128

[58] Field of Search ..... 333/125, 127, 128, 136, 333/137; 330/286, 295

[56] References Cited

U.S. PATENT DOCUMENTS 4,291,278 9/1981 Quine ..... 330/286

4,599,584 7/1986 Sasser et al. ..... 333/125

FOREIGN PATENT DOCUMENTS 225704 12/1983 Japan ..... 333/127

*Primary Examiner*—Paul Gensler

*Attorney, Agent, or Firm*—Bromberg & Sunstein

[57] ABSTRACT

An electrical energy transport arrangement has an arcuate boundary region of substantially constant radius. A first port is disposed substantially at the center of the curvature of the arcurate boundary region and lies at the boundary of the transport arrangement and in electrical communication with it. A plurality of second ports are disposed around the arcuate boundary region and in electrical communication with it. A preferred embodiment provides a purely planar configuration, which may optionally provide balanced phase and amplitude outputs. In other preferred embodiments, there are provided unequal amplitude outputs.

9 Claims, 13 Drawing Sheets

MULTIPORT POWER DIVIDER-COMBINER

The Government has rights in this invention pursuant to Contract No. F19628-85-C-0002 awarded by the United States Air Force.

DESCRIPTION

1. Technical Field

The present invention relates generally to power divider and combiner circuits, and particularly to those circuits operative at microwave and millimeter-wave frequencies.

2. Background Art

"Multiple-Port Power Divider/Combiner Circuits Using Circular Microstrip Disk Configurations," a paper by the inventors herein, *IEEE Transactions on Microwave Theory and Techniques,* vol. MTT-35, pp. 1296–1302 (Dec. 1987), which is hereby incorporated herein by reference, discusses and analyzes rf power divider/combiners of the type using a circular microstrip disk having a coaxially fed port at its center and a plurality of line ports disposed symmetrically around its circumference. A related configuration is disclosed in U.S. Pat. No. 4,647,879, issued for an invention of Vaddiparty. While such configurations typically do not exhibit any imbalance in the amplitude or phase of the output signals over a wide frequency range, their vertically oriented center port prevents them from being used in truly planar applications.

Another approach used in planar applications utilizes a generally symmetrical binary configuration, wherein a single line port on one side of the circuit feeds a pair of line ports on the other side of the circuit. A related configuration is disclosed in U.S.Pat. No. 4,725,792, issued for an invention of Lampe, Jr. While such configurations are purely planar, division into more than two signals or the combining of more than two signals requires cascading and concomitant loss of power, as well as requiring additional space and components.

See also, A. Fathy and D. Kalokitis, "Analysis and design of a 30-way radial combiner for the Ku-band applications," *RCA Rev.,* vol. 47, pp. 487–508, Dec. 1986; S. J. Foti, R. P. Flam, and W. J. Scharpf, "60-way radial combiner uses no isolators," *Microwaves and RF,* pp. 96–118, July 1984; and A. A. M. Saleh, "Planar electrically symmetric N-way hybrid power dividers/-combiners," *IEEE Trans. Microwave Theory Tech.,* vol. MTT-28, pp. 555–563, June 1980.

DISCLOSURE OF INVENTION

The invention utilizes an electrical energy transport arrangement that has an arcuate boundary region of substantially constant radius. A first port is disposed substantially at the center of the curvature of the arcurate boundary region and lies at the boundary of the transport arrangement and in electrical communication with it. A plurality of second ports are disposed around the arcuate boundary region and in electrical communication with it. In a preferred embodiment, the invention provides a purely planar configuration, which may optionally provide balanced phase and amplitude outputs. In other preferred embodiments, there are provided unequal amplitude outputs.

BRIEF DESCRIPTION OF THE DRAWINGS

Further details of the invention are described below with reference to the accompanying drawings, in which.

DESCRIPTION OF SPECIFIC EMBODIMENTS

Figure 1:
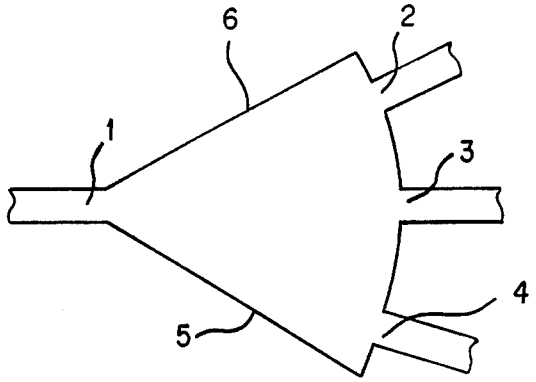
FIG. 1 shows the geometry of a sectorial power divider/combiner in accordance with a preferred embodiment of the invention.

The present invention utilizes in a preferred embodiment a sector-shaped planar segment such as in FIG. 1, where a first port 1 is at the center of the sector's radius of curvature with a second set of ports 2–4 distributed around the periphery. The sector is typically deposited on a planar dielectric, on the other side of which is a planar ground plate, in the manner of microstrip designs.

Figure 2:
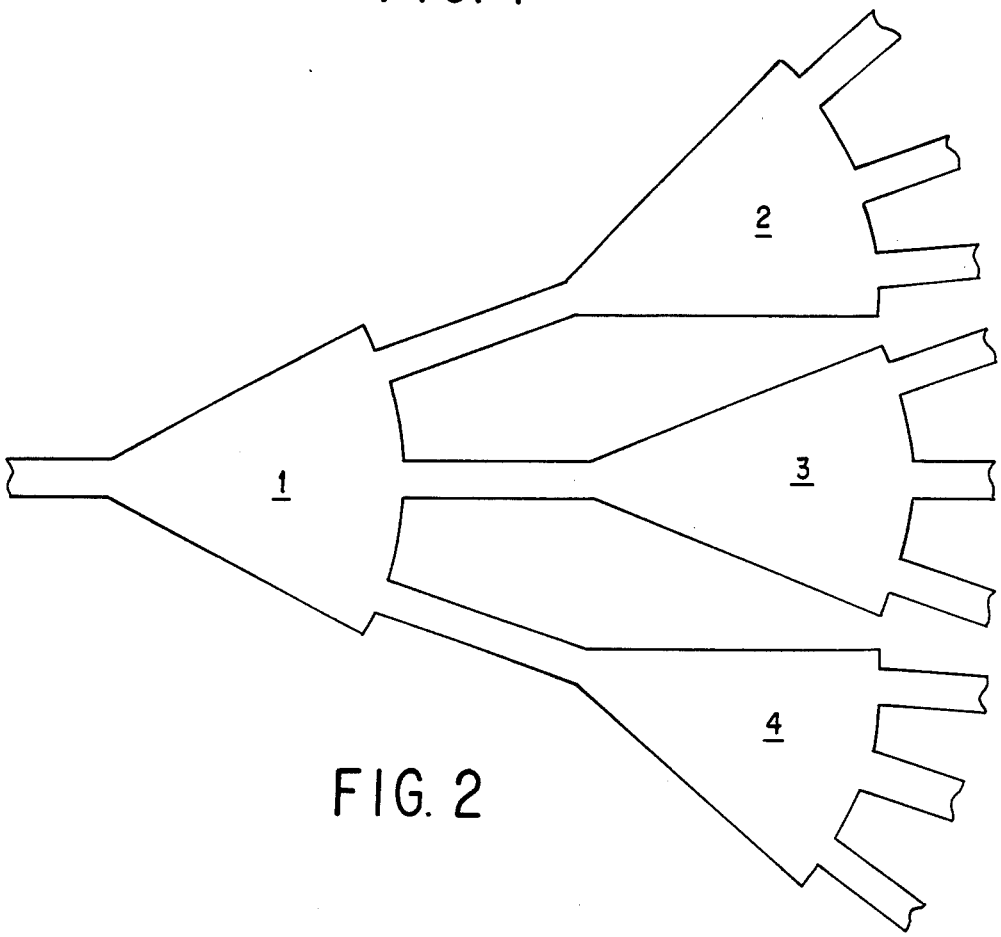
FIG. 2 shows cascading of sectorial power divider/-combiner circuits in accordance with a preferred embodiment of the invention.

One system application that motivated the invention is the need for replacing the lossy corporate feed structures used in feeding a linear array of antenna elements. A circular disk geometry with output lines extending radially in all directions is not appropriate for this purpose. On the other hand, the sector geometry with almost linearly aligned output ports, FIG. 1 is topologically more suitable. Also, the sector geometry shown in FIG. 1 is truly planar, as there is no need for the vertically oriented feed port which is used in the circularly symmetric configuration. This, of course, makes it easy to integrate these circuits in the same plane and on both the input and output sides. Furthermore, these power divider-combiner circuits may be cascaded in a fan-out or a fan-in manner as shown in FIG. 2. Another promising feature offered by these circuits is the flexibility in obtaining unequal output power levels at various ports, discussed below. This characteristic can be used for the amplitude tapering feature often required in antenna arrays. The power level at the various output ports 2–4 in FIG. 1 can be controlled by adjusting the locations and/or widths of the microstrip lines connected to these ports. Altering the widths of the output ports, however, may require the inclusion of quarter-wave impedance transformers so that proper match can be ensured.

It will be appreciated that the sector angle and number of circumferential ports are not limited to the examples shown herein, and the angle and number may vary widely.

The analysis of these circuits by the two-dimensional planar circuit approach is described herein. The impedance matrix elements for sector-shaped segments have been derived and are given in the next section. Four-way and five-way power divider circuits have been designed, fabricated, and tested. The measured and calculated scattering parameters are found to be in good agreement

THEORETICAL ANALYSIS

The planar circuit analysis approach used in our above Dec. 1987 article for circular disk power divider circuits turns out to be applicable to circuits with sectorial geometry. The analysis procedure for 90° and 180° sectorial circuits is summarized in this section.

A. Analysis of 90° Sectorial Circuit

Figure 3:
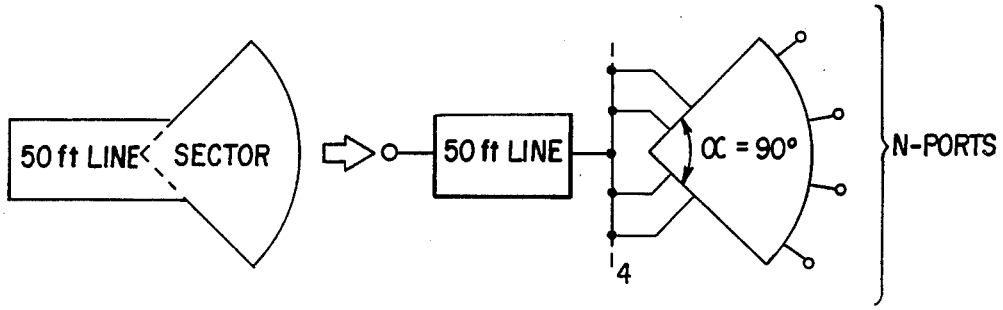
FIG. 3 shows the modeling procedure for a 90° sectorial circuit in accordance with a preferred embodiment of the invention.

The analysis of the 90° circular sector is modeled in FIG. 3 and is carried out by deriving the Z-matrix elements using $$Z_{ij} = \frac{1}{W_i W_j} \int w_i \int w_j G(s_i/s_j) ds_i ds_j \tag{1}$$

where $W_i$ and $W_j$, respectively, represent the effective widths of ports i and j, and $ds_i$, $ds_j$ are incremental distances along the port widths. See K. C. Gupta, R. Garg, and R. Chadha, *Computer Aided Design of Microwave Circuits,* Dedham, MA: Artech House, 1981, ch. 11. The quantity $G(s_i/s_j)$ in (1) denotes the two-dimensional impedance Green's function for the circular sector. The impedance Green's function for a circular sector having a sector angle $\alpha$ equal to integral submultiples of $\pi$ radians (180°), (i.e., $\alpha$=180°, 90°, 60°, 45°, 30°, 22.5°, etc.) is available in the literature (see *Computer Aided Design of Microwave Circuits,* ch. 11) and is used here for deriving the impedance matrix. Upon substituting $G(s_i/s_j)$ into (1) and carrying out the integrations, various elements of the impedance matrix are obtained.

Figure 4:
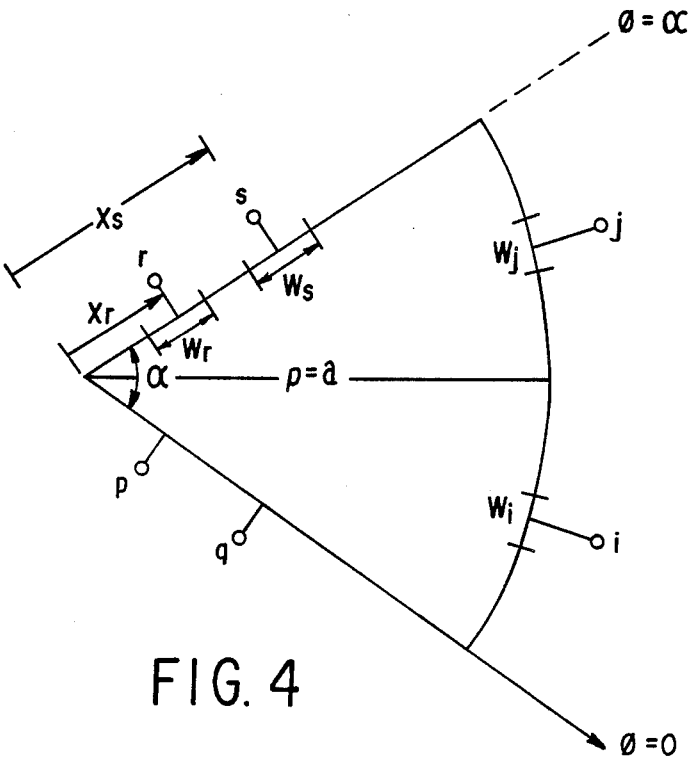
FIG. 4 shows the port locations and nomenclature used in analyzing a sectorial circuit in accordance with a preferred embodiment of the invention.

FIG. 4 shows the part locations and nomenclature used for the analysis of the model.

When the ports are located along the curved edge of the sector (i.e. at $\rho$=a), the self-and transfer impedance elements of the Z-matrix are given by $$Z_{ij} = \frac{2j\omega\mu d\alpha^2}{\alpha W_i W_j}. \tag{2}$$

-continued $$\sum_{n=0}^{\infty} \sum_{m=1}^{\infty} \frac{\sigma_n\{\cos(n_s\phi_{ij}) + \cos[n_s(\phi_i + \phi_j)]\}}{n_s^2\left[\alpha^2 - \frac{n_s^2}{k_{mns}^2}\right][k_{mns}^2 - k^2]} \cdot \left\{\cos\left[\frac{n_s}{2}(\Delta_i - \Delta_j)\right] - \cos\left[\frac{n_s}{2}(\Delta_i + \Delta_j)\right]\right\}$$

where parameter $\sigma_n$ is defined as $$\sigma_n = \begin{cases} 1 & \text{for } n = 0 \\ 2 & \text{otherwise} \end{cases} \tag{3}$$

where $k = k_o\sqrt{\epsilon_r}$. Here $\epsilon_r$ is the dielectric constant of the substrate, $\mu$ is the permeability, $\omega$ is the radial frequency, $k_o$ is the free-space wavenumber, d is the height of the substrate, $\alpha$ is the sector angle (90° in this case), a is the effective radius of the sector [6], and $W_{i,j}$ are the effective widths of the ports measured along the sector edge $\rho$=a. In addition, the term $\phi_i$ represents the angular location of port i, $\Delta_i = W_i/a$ is the angular width of port i, $\phi_{ij}$ is the angular distance between ports i and j, and $n_s = n\pi/\alpha$. The values of $k_{mns}$ are determined by the magnetic wall boundary conditions at $\rho$=a and are given by $$\left.\frac{\partial J_{n_s}(k_{mns}\rho)}{\partial\rho}\right|_{\rho=\alpha} = 0. \tag{4}$$

When the ports are located along the straight edge $\phi=\alpha$ of the sector, the self-and transfer impedance elements are given by $$Z_{rs} = \frac{2j\omega\mu d}{\alpha W_r W_s} \cdot \sum_{n=0}^{\infty} \sum_{m=1}^{\infty} \frac{\sigma_n T(\alpha) I_{n_s}(r) I_{n_s}(s)}{(k_{mns}^2\alpha^2 - n_s^2)(k_{mns}^2 - k^2) J_{n_s}^2(k_{mns}\alpha)} \tag{5}$$

where $W_r$ and $W_s$ represent the effective linear widths of the ports and $$T(\alpha) = \cos^2(n_s\alpha) = 1. \tag{6}$$

In addition, $$I_{n_s}(r) = \begin{cases} \int_{\gamma_{r1}}^{\gamma_{r2}} J_0(t)dt - 2\sum_{k=0}^{n_s/2-1} [J_{2k+1}(\gamma_{r2}) - J_{2k+1}(\gamma_{r1})] & \text{for } n_s \text{ even} \\ J_0(\gamma_{r1}) - J_0(\gamma_{r2}) + 2\sum_{k=1}^{(n_s-1)/2} [J_{2k}(\gamma_{r2}) - J_{2k}(\gamma_{r1})] & \text{for } n_s \text{ odd} \end{cases} \tag{7}$$

with $$\gamma_{r1} = k_{mns}\left(x_r - \frac{W_r}{2}\right) \tag{8}$$

$$\gamma_{r2} = k_{mns}\left(x_r + \frac{W_r}{2}\right) \tag{9}$$

where $X_r$ and $W_r$ denote, respectively, the location and the effective width of the port r, as defined in FIG. 4. The term $I_{ns}(s)$ in (5) is obtained by replacing r with s in (7), (8), and (9).

When the ports are located at the straight edge $\phi=0$, $Z_{pq}$ is given by (5) with $\alpha=0$ in (6). Similarly, when one port is located at $\phi=0$ and the other port is located at $\phi=\alpha$, the transfer impedance element $Z_{pr}$ is also given by (5), but with $T(\alpha)=\cos(n_s\alpha)$ instead.

The transfer impedance element $Z_{ir}$ between two ports, one located at the curved edge $\rho=a$ and the other located at the straight edge $\phi=\alpha$, of the sector is given by $$Z_{ir} = \frac{4j\omega\mu d\alpha}{\alpha W_i W_r} \cdot \tag{10}$$

$$\sum_{n=0}^{\infty}\sum_{m=1}^{\infty} \frac{\sigma_n \cos(n_s\alpha)\cos(n_s\phi_i)\sin\left(n_s\frac{\Delta_i}{2}\right)I_{ns}(r)}{n_s k_{mns}\left(a^2-\frac{n_s^2}{k_{mns}^2}\right)(k_{mns}^2-k^2)J_{ns}(k_{mns}a)}$$

The transfer impedance $Z_{ip}$ between two ports, one located at $\rho=a$ and the other located at $\rho=x_p$ and $\phi=0$, can be obtained from (10) by setting $\alpha=0$ in the $\cos(n_s\alpha)$ term.

Upon utilizing (2) through (10), an impedance matrix of dimensions $(N+4)\times(N+4)$ suitable for characterizing the configuration of FIG. 3 is obtained. The term N here represents the number of output ports at the circumference, whereas the number of subports used to model the junction at the feed port is 4. The division of the feed port into several subports (four in this case) accounts for the variation of the edge voltage near the sector apex. The number of subports is chosen such that a constant voltage along the width of each subport is ensured, as required by (1). These four subports, each of width $W_i/4$, are then connected to the feeding microstrip line, and the $(N+4)\times(N+4)$ impedance matrix is reduced to an $(N\times N)$ matrix. This is performed by first converting the $(N+4)\times(N+4)$ Z-matrix into the corresponding admittance matrix and then combining the four rows and four columns corresponding to these subports into a single row and a single column as discussed in *Computer Aided Design of Microwave Circuits,* chapter 11, referenced above. The resulting $(N\times N)$ admittance matrix is then converted into a scattering matrix.

Figure 5:
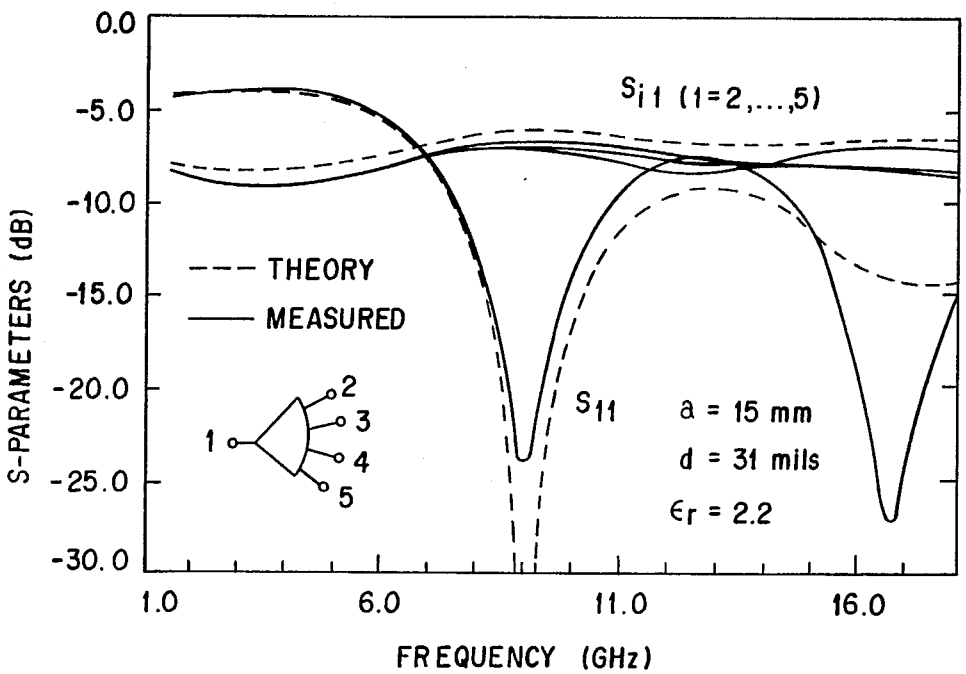
FIG. 5 plots measured and calculated scattering parameters of a four-way 90° sector power divider in accordance with a preferred embodiment.
Figure 6:
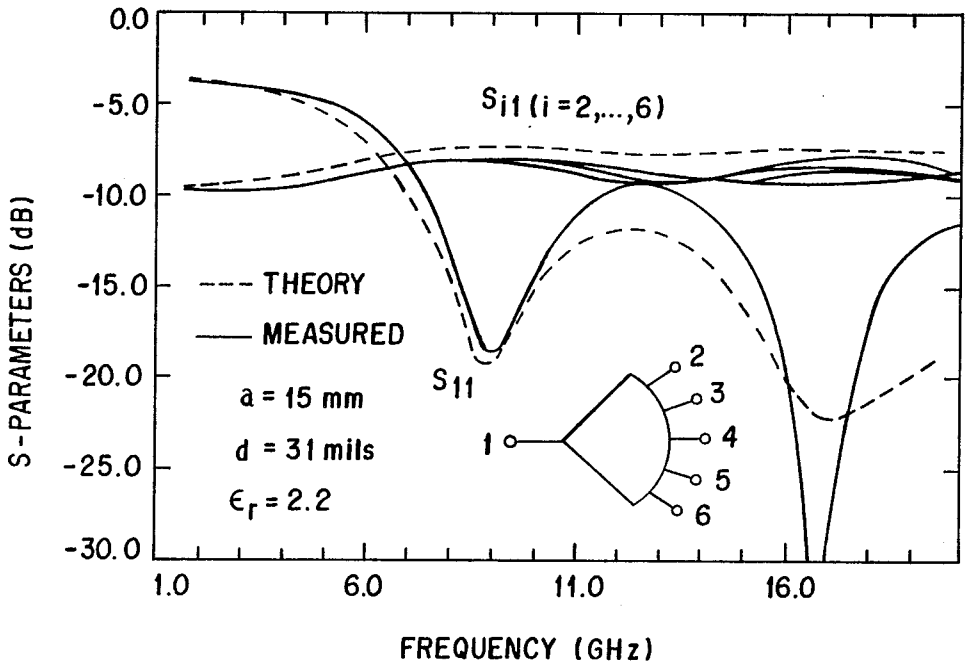
FIG. 6 plots measured and calculated scattering parameters of a five-way 90° sector power divider in accordance with a preferred embodiment.

FIGS. 5 and 6 illustrate, respectively, the calculated scalar S parameters for 90° four-way and five-way power dividers. These figures also include the experimental results discussed below. In the course of computing these results the values of m and n in the summations occurring in (2), (5), and (10) were taken to be 30 each. The value was chosen by noting the convergence of the numerical results in the frequency range of interest. For better convergence at frequencies above 15 GHz, larger values of m and n are needed.

As shown in FIGS. 5 and 6 equal power division and good input match are achieved at the frequencies which correspond to the resonances of the (n,0) azimuthal symmetric modes. The port locations in these configurations were determined by dividing the circumferential edge of the sector in N sections (N=4 in FIG. 5 and N=5 in FIG. 6) of equal width. One output port is then positioned at the middle of each of these N sections. Such a choice is primarily influenced by the desire to maintain physical symmetry, which helps in obtaining equal power division.

B. Analysis of 180° Sectorial Circuit

Figure 7:
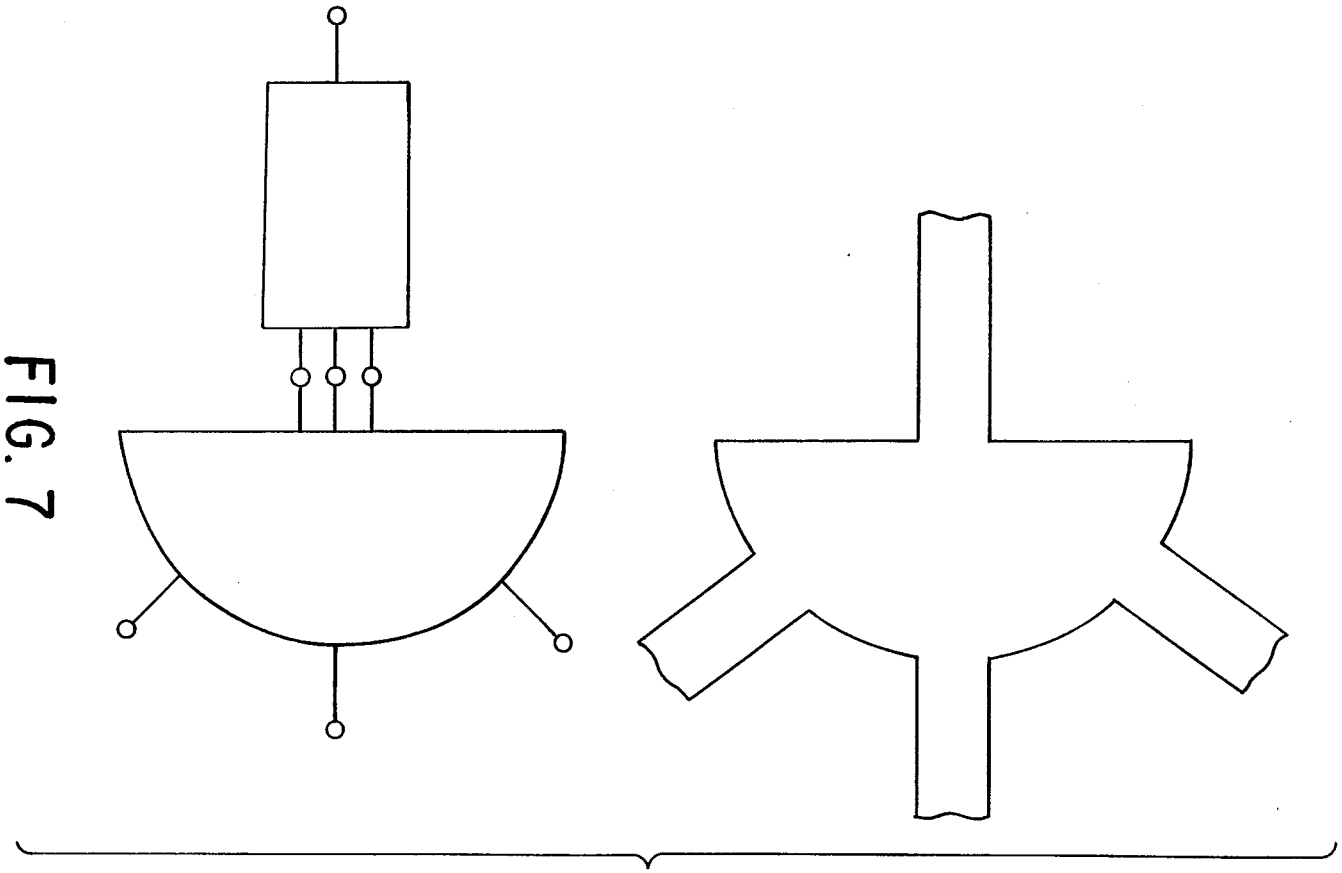
FIG. 7 illustrates a 180 sectorial circuit in accordance with a preferred embodiment of the invention.

The case of 180° sector shown in FIG. 7 can also be analyzed by using (2) through (10) but with $\alpha=180°$. However in this case a more accurate analysis is carried out by taking into account the effect of the higher order evanescent modes generated at the junction between the feed port and the sector. This is performed by modeling a small section of the microstrip feed line as a two-dimensional planar component and then using the segmentation procedure. This more accurate approach was implemented and found to produce results very close to those obtained in the previous section (i.e., without the use of segmentation and by combining the four subports into a single port). Here, again, the values of m and n needed for the convergence of the summations occurring in (2), (5), and (10) were found to be m=n=30, which have been used for the numerical results reported in this paper.

Figure 8:
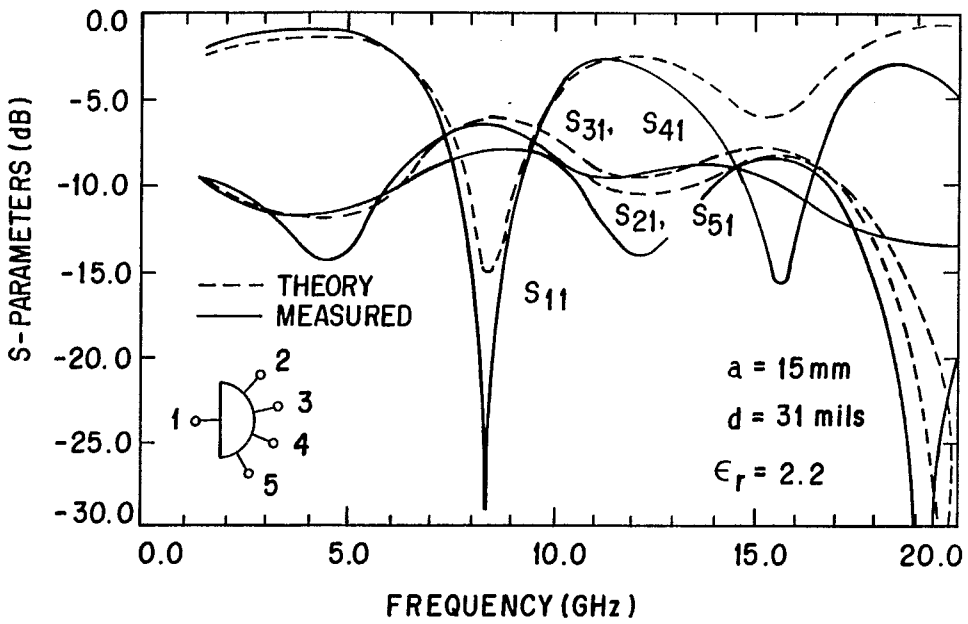
FIG. 8 plots measured and calculated scattering parameters of a four-way 180 °sector power divider in accordance with a preferred embodiment.

The magnitudes of $S_{11}$, $S_{21}$, $S_{31}$, $S_{41}$, and $S_{51}$ are plotted as functions of frequency in FIG. 8. Again equal power division was obtained at the resonance frequencies of the (1,0) and (2,0) azimuthal symmetric modes. The asymmetric modes, however, play a more significant role in this case than in the case of 90° sectorial circuits. The presence of these higher order modes disturbs the amplitude balance observed in the 90° sectorial circuits described earlier. Furthermore, the equal power division and good match seem to coincide only over a limited frequency range as shown in FIG. 8.

For the results presented in subsections A and B, the dielectric and conductor losses were incorporated in the same manner as described in our above Dec. 1987 article. The radiation losses, on the other hand, were not included. It may be noted that for these circuits, which have five or six external ports, the loaded Q factor becomes very small and the radiation loss is expected to be small, even at the resonance.

EXPERIMENTAL RESULTS

Figure 9:
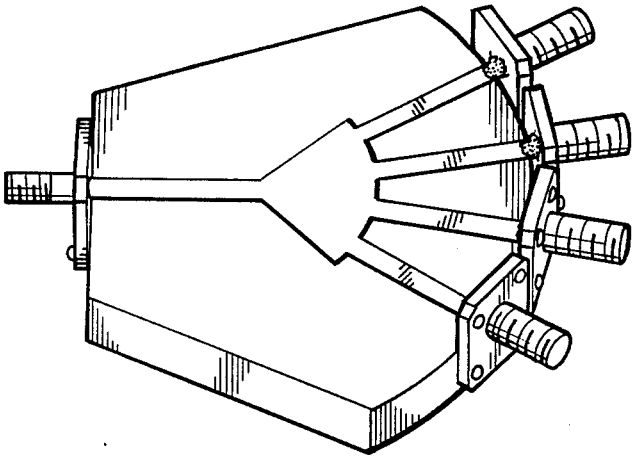
FIG. 9 is a perspective view of a divider/combiner in accordance with a preferred embodiment of the invention.

In order to verify the accuracy of the method of analysis a number of power divider/combiner circuits have been designed, constructed, and tested. A perspective view of one such divider/combiner is shown in FIG. 9.

A comparison between the measured and calculated performance of the 90° four-way power divider circuit is shown in FIG. 5. As shown, excellent agreement between the measured and calculated magnitudes of $S_{11}$, $S_{21}$, $S_{31}$, $S_{41}$, and $S_{51}$, is obtained. The gating feature on the HP 8510 Automatic Network Analyzer (ANA) has been used to remove the effect of the connectors. It is evident from these data that this circuit can be used as a power divider in two different frequency bands. This is because the return loss $S_{11}$, is less than −12 dB in the frequency bands 8–10 GHz and 15–19 GHz. Perfect amplitude balance is obtained both experimentally and theoretically over the lower frequency band. The experimental values of the transmission coefficients were −6.7 dB at the center frequency. In the higher frequency band, the amplitude balance suffers slightly but remains good within ±0.6 dB. It is believed that the discrepancy between measurement and theory occurring at frequencies above 14 GHz is partly due to the poor convergence of the summations of (2), (5), and (10). An improved convergence was observed when the values of m and n were changed from 20 to 30.

The port-to-port phase balance has been measured and found to be within ±2° over the frequency band 8 to 10 GHz. The corresponding theoretical values are within ±0.1°. The isolation between the output ports varies from −5 to −25 dB over the lower frequency band, whereas the values for the upper frequency band are between −8 and −14 dB, depending upon the port location. These isolation values are obtained without the use of any external resistors. If needed, external resistors can be used to improve the isolation performance of these circuits.

FIG. 6 illustrates a comparison between the measured and calculated scalar characteristics of a five-way 90° power divider. This configuration has the same physical dimensions (i.e., a=1.5 cm and d=31 mils) as the four-way circuit described in FIG. 5. As in the previous four-way case, the gating feature in the HP 8510 ANA is used to remove the effect of the connectors. Upon inspecting the frequency characteristics of these circuits it becomes apparent that there are two frequency bands of operation. Considering −12 dB to be an acceptable level for the input reflection coefficient $S_{11}$, the first frequency band is found to be centered around the (1,0) resonant mode and extends from 7.7 to 10.5 GHz. The second frequency band is centered around the resonance frequency of the (2,0) azimuthal symmetric mode and extends from 14.5 GHz to abut 19 GHz. Once again discrepancy between theory and measurement starts to appear above 16 GHz.

Finally FIG. 8 shows a comparison between the measured and calculated scalar characteristics of a four-way 180° sector power divider. The amplitude balance in this case is not as good as in the two previous configurations. Furthermore, good impedance matching and equal power division do not occur concurrently at the same frequency. It is believed that this is due to the more significant role played by the higher order modes in this case.

FURTHER DESIGN CONSIDERATIONS

Using the equations of above Dec. 1987 article, it is possible to determine the sector's radius after specifying the frequency f of operation and the thickness d and dielectric constant $\epsilon_r$ of the material on which the sector is disposed. The relation is $$a_e = \frac{c}{2\pi\sqrt{\epsilon_r}} \cdot \frac{j_{nm}'}{f}, \tag{11}$$

where c is the velocity of light, $j_{nm}'$ are solutions of $J_n'(X)=0$, n is the order of the Bessel function J(X), m is the number of the particular zero crossing of a given solution, and $a_e$ is the effective radius of the sector. The physical radius $a_o$ of the sector can be determined by solving for this variable in equation (1) of our article:

$$a_e = a_0\left\{1 + \frac{2d}{\pi\epsilon_r a_0}\left[\ln\frac{\pi a_0}{2d} + 1.7726\right]\right\}^{\frac{1}{2}} \tag{12}$$

As mentioned above, sector angles other than those analyzed here are within the scope of the invention. Although the sector embodiments described above have lateral boundaries (5 and 6 of FIG. 1), between the center (port 1 of FIG. 1) of curvature of the sector and the circumference, that coincide with sector radii, the lateral boundaries (5–6) need not necessarily be straight. Nor do the ports (2–4) need necessarily be symmetrical or evenly spaced. The invention is not limited to microstrip applications. Air may be used as the dielectric, for example, between a sector such as described above and a conductive ground plate. Alternatively, the geometry herein described may be used in a waveguide with a horizontal section that is sector-shaped, one port being disposed at the center of curvature of the sector and a plurality of ports being disposed along the circumference, so that FIG. 1 herein effectively shows a horizontal section of an example of such a waveguide.

UNEQUAL POWER DIVIDER EMBODIMENTS

When the lateral boundaries (5 and 6 of FIG. 1) are perturbed, it is possible to produce an unequal power divider in accordance with the present invention. (Unequal power dividers are desirable, for example, in the design of feed networks for linear antenna arrays. In order to reduce the sidelobe levels in these arrays, the central elements are excited with higher inputs than the elements at the two ends of the array.) One method of perturbation is the use of shorting pins in the microstrip embodiments discussed above.

Figure 10:
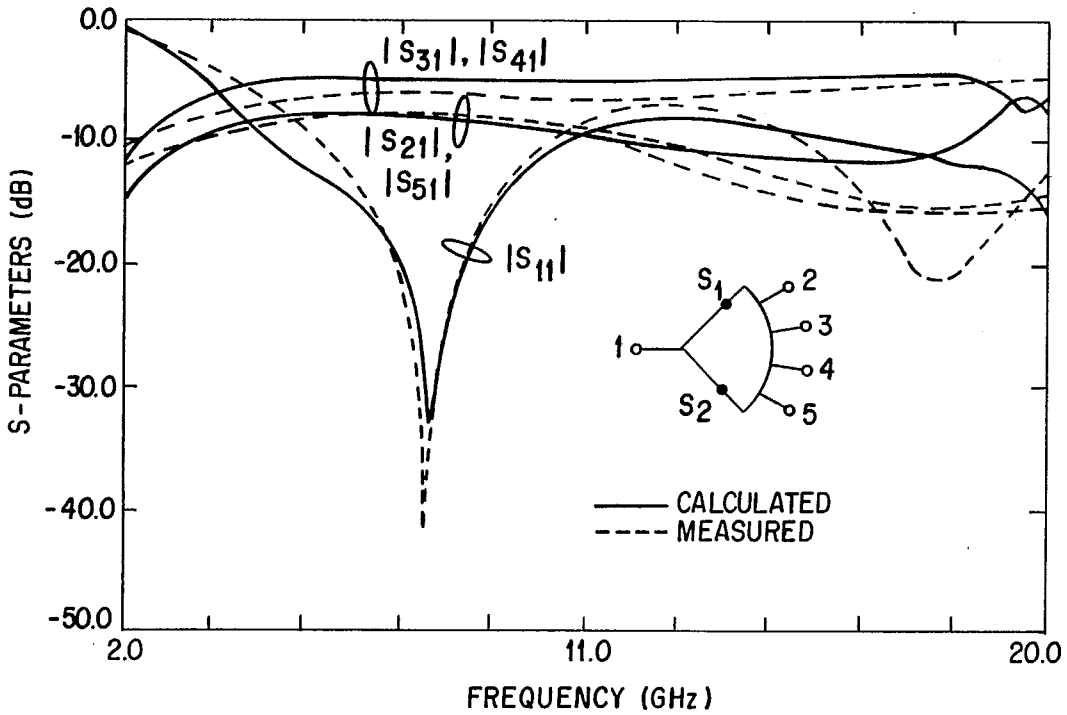
FIG. 10 illustrates the configuration of a planar four-way unequal power divider in accordance with a preferred embodiment of the invention.

An embodiment for planar power dividers with unequal outputs is shown in FIG. 10. It uses a sector-shaped geometry with the input port located at the apex of the center whereas the various output ports are located along the circumferential edge. The shorting pins $S_1$ and $S_2$ are 1 mm diameter (other sizes are within the scope of the invention) metallic fuzz buttons connecting the top conductor to the ground plane. Multiple shorting pins (more than one) may also be used at the radial edges. In absence of these shorting pins, the configuration is identical to that described above for equal output power divider circuits. As discussed above, the equal power divider circuits operate in two different frequency bands centered around the resonance frequencies of the (1,0) and the (2,0) modes. Both of these modes are azimuthally symmetric hence yielding uniform voltage distribution along the open circuited circumferential edge. This azimuthal symmetry leads to equal power outputs.

As an alternative to the use of shorting pins or in addition thereto, there can be used a conductive strip of appropriate length. An appropriate length for some applications may be one-quarter wavelength.

By locating shorting pins along the radial edges, modes with azimuthal field variation are excited. This is in addition to the (1,0) and (2,0) modes mentioned earlier. These asymmetric modes reduce the voltage on portions of the circumferential edge near the radial edges, causing the output power from the ports located near the radial edges to be reduces.

Extensive experiments have been carried out on 4-way power divider circuits fabricated on a 31 mil Duroid ($\epsilon_r$=2.2) substrate. The sector angle of the circuit is 90° and the radius is 1.5 cm. All the input-output lines have $Z_o$=50Ω. Measurements have been carried out over the frequency range 2.0–20.0 GHz using the HP 8510 Automatic Network Analyzer. The gating feature on the HP 8510 has been used to remove the effect of connectors.

Figure 11:
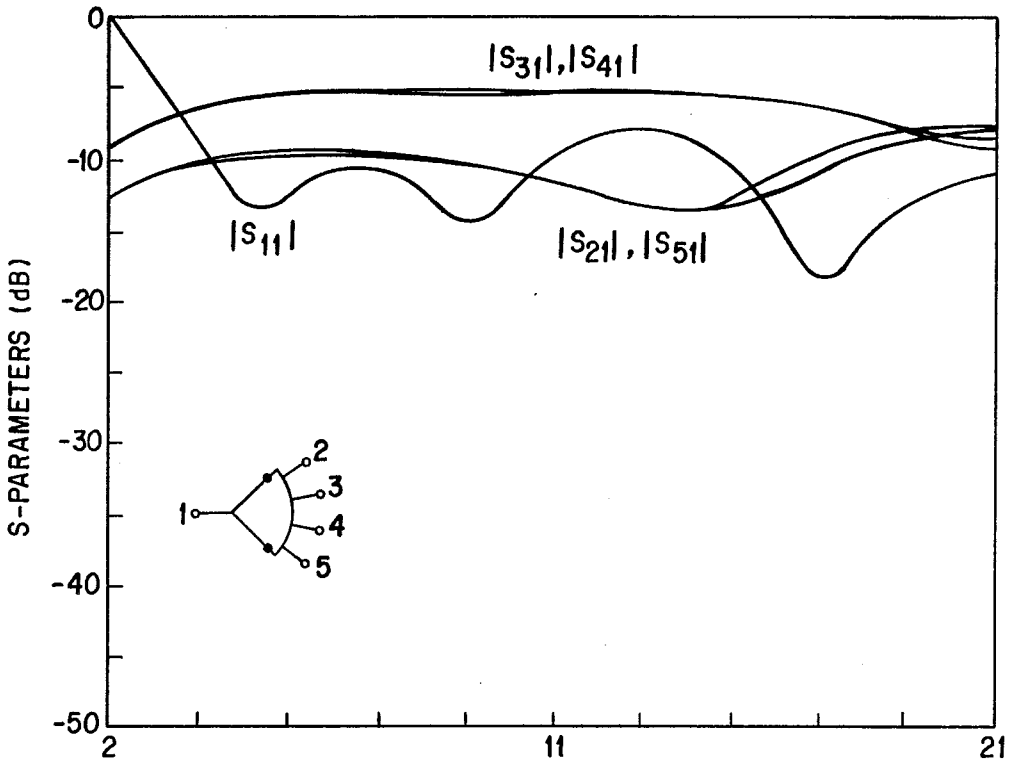
FIGS. 11–13 plot measured characteristics of a four-way unequal power divider in accordance with preferred embodiments of the invention when the shorting pins are located 0.22, 0.33, and 0.44 cm respectively from the circumferential edge.
Figure 12:
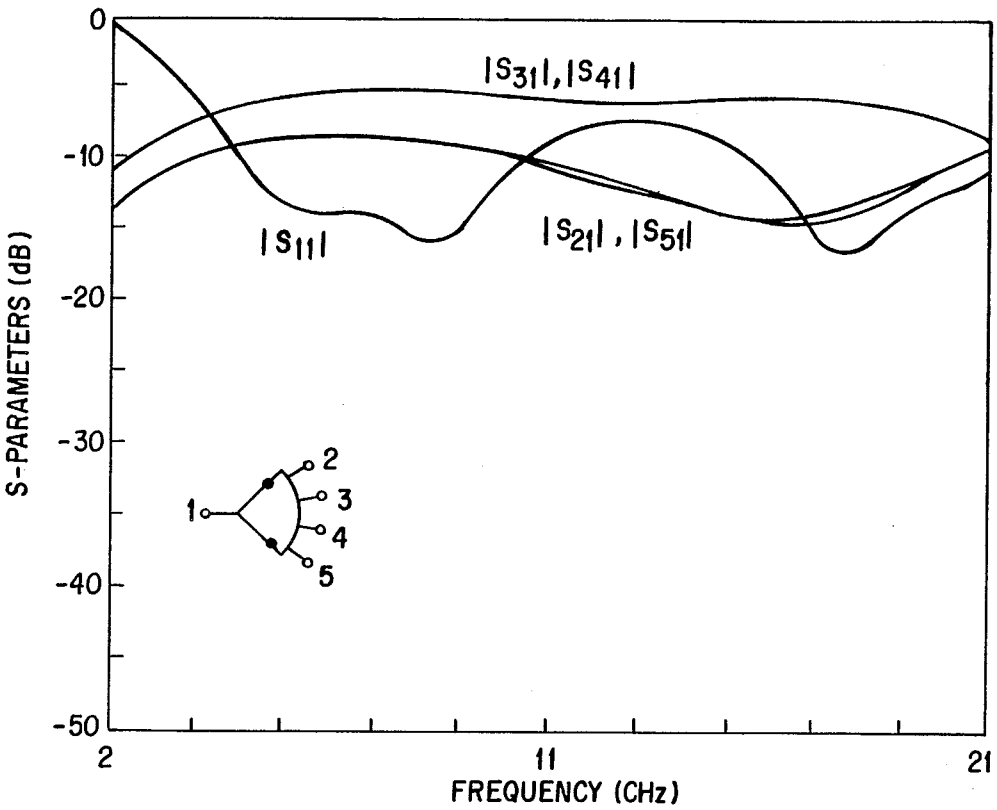
Figure 13:
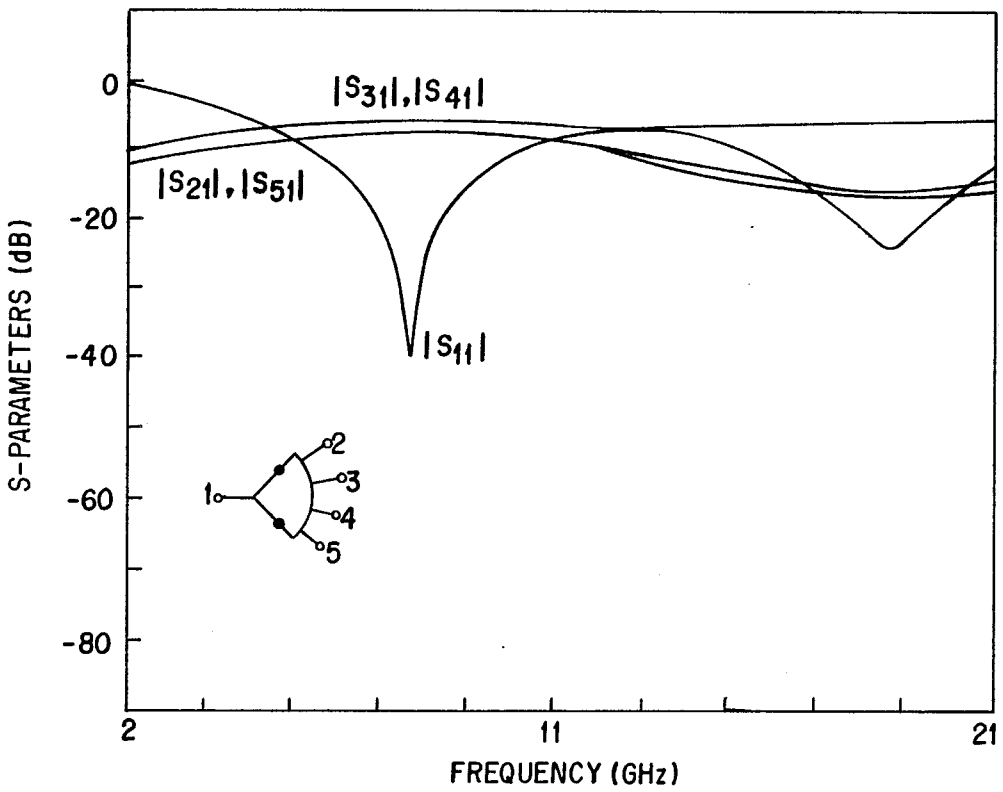

Measurements for three different locations of two shorting pins (one on each of the radial edges) are shown in FIGS. 11, 12 and 13. In these three cases the pins were located at distances of 0.22 cm, 0.33 cm, and 0.44 cm from the circumferential edge. Interesting results are observed in all of the three cases, and unequal power division is obtained in both the lower frequency band (around the (1.0) mode) and the higher frequency band (around the (2,0) mode). Perhaps the most interesting case is the one shown in FIG. 12 (shorting pins 0.33 cm from the circumference). Return loss of less than −14 dB is obtained over the frequency range 5.8 to 9.0 GHz (a bandwidth of 43.24%). For $S_{11} < -10$ dB the bandwith is about 77%. Over this bandwidth the output at the outer ports (#2 and 5) is −9.5 dB (±0.5 dB) whereas the power output at the inner ports (#3 and 4) is 5.5 dB (±0.25 dB). Thus, fairly wideband power dividers may be designed using this approach.

Figure 14:
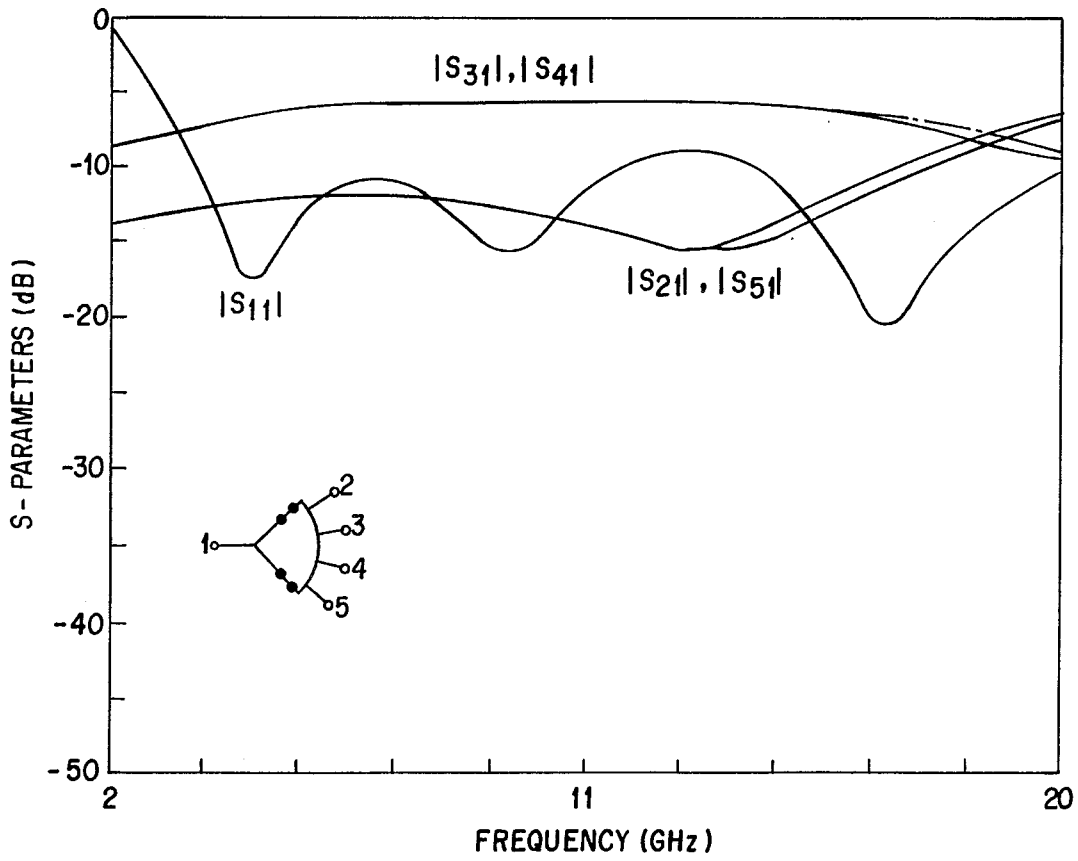
FIG. 14 plots measured characteristics of a four-way unequal power divider in accordance with a preferred embodiment of the invention when the shorting pins are located at both 0.22 and 0.11 cm from the circumferential edge.

A modification of the design described above is obtained by using two shorting pins on each of the radial edges. A number of experiments were carried out for several different locations of these pins. Results for one of these (with pins located at distance 0.22 cm and 0.11 cm from the circumferential edge) are shown in FIG. 14. The most interesting feature of this configuration is the response for $S_{11}$, whose value is −12.0 dB (±1 dB) from 3.8 GHz to 10.5 GHz (a bandwith of 46.85%). Power output at the inner (#3 and 4) and the outer ports are −6 dB (±0.5) and the outer ports are −12.5 dB (±0.5) respectively over the range.

Experiments with a larger number of shorting pins (3 pins and 5 pins on each of the radial edges) were also conducted but did not yield any better results.

The proposed power-divider configuration can be analyzed theoretically by using the two dimensional planar circuit approach. This is an extension of the approach described above to analyze power divider circuits with equal outputs.

The theoretical analysis is convenient when the sector angle $\alpha$ is a sub-multiple of 180° because the Green's function method can be applied. For any other sector angle, the contour integral approach may be used for evaluating the Z-matrix of the sectorial segment. When $\alpha = 180°/n$, the expressions for the elements of the Z-matrix are obtained from the corresponding Green's functions. These expressions involve infinite series with double summations described When the shorting pins are incorporated the analysis procedure is modified as follows:

1. Extra ports are located at the position of the shorting pins. The effective width of these ports is taken equal to the diameter of the shorting pins used.
2. The Z-matrix is computed with these additional ports taken to be open circuited. For example, in the case of a four-way power divider with two shorting pins (one at each radial edge) we consider a 10-port component and evaluate a 10×10 Z-matrix. The additional three ports are due to the fact that the input port has been divided into four subports.
3. The 10×10 Z-matrix is converted to the corresponding 10×10 Y-matrix, which in turn is reduced to the 5×5 Y-matrix when the two extra ports on the radial edge are shorted and the four subports at the feed are combined into a single port. Shorting of the two radial ports corresponds to the removal of the rows and columns corresponding to these two ports from the Y-matrix.
4. The resulting 5×5 matrix yields the characterization of the circuit with shorted ports and may be converted to the Z or S-matrix.

Inductive impedances of the shorting pins may be taken into account by following a procedure similar to that discussed in our Dec. 1987 article.

Figure 15:
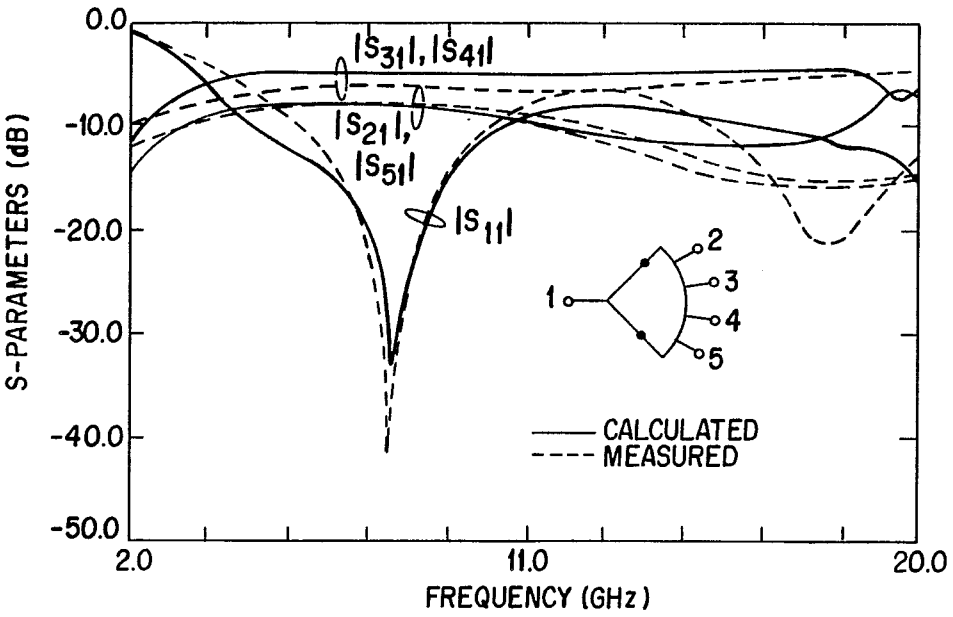
FIG. 15 plots measured and calculated characteristics of a four-way 90° sector unequal power divider, with radius of 1.5 cm, d=1/32 in., $\epsilon_r=2.2$, and shorting pins located on the radial edge 0.44 cm from the circumferential edge.

This theoretical procedure has been implemented. A comparison between the theoretical and experimental results is shown in FIG. 15. for a four-way unequal power divider. The lack of agreement above 15 GHz is due to the limited number of terms (n=m=40) used in the evaluation of the elements of impedance matrix. This observation is consistent with the computation described above for the 90° sector four-way equal power divider. If desired a better accuracy can be obtained by increasing the number of terms in the series. This of course will increase the computational time.

What is claimed is:

1. A power divider/combiner comprising:

electrical energy transport means, having an arcuate boundary region of substantially constant radius for transporting electrical energy;

a first port, disposed substantially at the center of curvature of the arcuate boundary region, and lying at a boundary of the electrical energy transport means and in electrical communication therewith; and a plurality of second ports, disposed around the arcuate boundary region and in electrical communication therewith;

wherein the electrical energy transport means and each of the ports includes a planar energy conductor element disposed parallel to a ground conductor and the ports are coplanar.

2. A divider/combiner according to claim 1, wherein the second ports are substantially evenly spaced around the arcuate boundary region.

3. A divider/combiner according to claim 1, wherein the arcuate boundary region has first and second ends, with first and second boundary regions lying between the center of curvature and each of the first and second ends respectively of the arcurate boundary region, and the divider/combiner further comprises:

perturbation means, disposed proximately to at least one of the first and second boundary regions, for producing an unequal distribution of electrical energy in the electrical energy transport means accessed via the ports.

4. A divider/combiner according to claim 3, wherein the perturbation means includes at least one shorting pin disposed between the energy conductor and the ground conductor.

5. A divider/combiner according to claim 3, wherein the perturbation means includes at least one conductive strip disposed between the energy conductor and the ground conductor.

6. A divider/combiner according to claim 3, wherein the first and second boundary regions are bilaterally symmetric and the perturbation means is disposed proximately to both of the first and second boundary regions in bilaterally symmetric locations.

7. A divider/combiner according to claim 6, wherein the perturbation means includes a first shorting pin disposed between the energy conductor and the ground conductor proximate to the first boundary and a second shorting pin disposed between the energy conductor and the ground conductor proximate to the second boundary.

8. A divider/combiner according to claim 7, wherein the perturbation means includes a plurality of shorting pins disposed between the energy conductor and the ground conductor proximate to the first boundary and a plurality of shorting pins disposed between the energy conductor and the ground conductor proximate to the second boundary.

9. A divider/combiner comprising:

electrical energy transport means, having an arcuate boundary region of substantially constant radius, for transporting electrical energy, such means being a wave guide, wherein the arcuate boundary region has first and second ends, and first and second boundary regions lie between the center of curvature and each of the first and second ends respectively of the arcuate boundary region;

a first port, disposed substantially at the center of curvature of the arcuate boundary region, and lying at a boundary of the electrical energy transport means and in a electrical communication therewith;

a plurality of second ports, disposed around the arcuate boundary region and in electrical communication therewith; and perturbation means, disposed proximately to at least one of the first and second boundary regions, for producing an unequal distribution of electrical energy in the electrical energy transport means accessed via the ports.

* * * * *